US011202474B2

(12) United States Patent
Kettenbach

(10) Patent No.: US 11,202,474 B2
(45) Date of Patent: Dec. 21, 2021

(54) SOCK COMPRISING STIMULATION ELEMENTS

(71) Applicant: Birkenstock IP GmbH, Linz am Rhein (DE)

(72) Inventor: Robert Kettenbach, Stuttgart (DE)

(73) Assignee: BIRKENSTOCK IP GMBH, Linz am Rhein (DE)

( * ) Notice: Subject to any disclaimer, the term of this patent is extended or adjusted under 35 U.S.C. 154(b) by 72 days.

(21) Appl. No.: 15/769,956

(22) PCT Filed: Oct. 26, 2016

(86) PCT No.: PCT/EP2016/075838

§ 371 (c)(1),
(2) Date: Apr. 20, 2018

(87) PCT Pub. No.: WO2017/072191

PCT Pub. Date: May 4, 2017

(65) Prior Publication Data

US 2018/0310636 A1 Nov. 1, 2018

(30) Foreign Application Priority Data

Oct. 27, 2015 (DE) ..... 20 2015 105 707.5

(51) Int. Cl.
*A41B 11/00* (2006.01)
*A41B 11/02* (2006.01)

(52) U.S. Cl.
CPC ..... *A41B 11/007* (2013.01); *A41B 11/00* (2013.01); *A41B 11/02* (2013.01); *A41B 2400/322* (2013.01)

(58) Field of Classification Search
CPC ..... A41B 11/007; A41B 11/00; A41B 11/02; A41B 2400/322
See application file for complete search history.

(56) References Cited

U.S. PATENT DOCUMENTS 2,586,045 A * 2/1952 Hoza ..... A43B 3/108 36/9 R
4,651,354 A * 3/1987 Petrey ..... A41B 11/004 2/239

(Continued)

FOREIGN PATENT DOCUMENTS

CN 101194758 A 6/2008
CN 201336939 Y 11/2009

(Continued)

OTHER PUBLICATIONS

International Search Report with English translation and Written Opinion dated Feb. 1, 2017 of corresponding International application No. PCT/EP2016/075838; 12 pgs.

(Continued)

*Primary Examiner* — Richale L Quinn
(74) *Attorney, Agent, or Firm* — Maier & Maier, PLLC

(57) ABSTRACT

A sock having a sole that has impact zones in the toe region, the ball region and the heel region, the sole includes stimulation elements in a toe groove region located between the toe region and the ball region as well as in a metatarsal arch region located between the ball region and the heel region, but not in the impact zones.

12 Claims, 2 Drawing Sheets

(56) References Cited

U.S. PATENT DOCUMENTS

| | | | | |
|---|---|---|---|---|
| 4,852,272 | A * | 8/1989 | Chilewich | A43B 9/08 36/12 |
| 6,532,689 | B1 * | 3/2003 | Jones, Jr. | A43B 1/14 36/100 |
| 6,708,348 | B1 * | 3/2004 | Romay | D04B 1/26 2/239 |
| 8,424,116 | B2 * | 4/2013 | Anastsopoulos | A41B 11/003 2/239 |
| 8,984,669 | B2 * | 3/2015 | Song | A41B 11/007 2/239 |
| 10,456,287 | B2 * | 10/2019 | Shaffer | A41B 11/003 |
| 2002/0040588 | A1 | 4/2002 | Kalde | |
| 2008/0041113 | A1 * | 2/2008 | Mori | A41B 11/02 66/54 |
| 2008/0189829 | A1 * | 8/2008 | Fusco | A61F 13/08 2/239 |
| 2008/0229611 | A1 * | 9/2008 | Chiodo | A43B 17/035 36/29 |
| 2010/0050322 | A1 * | 3/2010 | Zagula | A41B 11/006 2/239 |
| 2010/0090812 | A1 * | 4/2010 | Cathcart | G08B 6/00 340/407.1 |
| 2012/0283611 | A1 * | 11/2012 | Matsuo | A41D 13/06 602/27 |
| 2013/0069936 | A1 | 3/2013 | Tsai et al. | |
| 2013/0263629 | A1 * | 10/2013 | Gaither | D04B 1/265 66/185 |
| 2013/0333096 | A1 * | 12/2013 | Song | A41B 11/02 2/239 |
| 2014/0331387 | A1 * | 11/2014 | Hennings | A41B 11/003 2/239 |
| 2015/0201703 | A1 | 7/2015 | Baravarian | |
| 2016/0166419 | A1 * | 6/2016 | Jones | D04B 1/26 602/66 |
| 2017/0035120 | A1 * | 2/2017 | Ramsey | D04B 1/12 |
| 2017/0325513 | A1 * | 11/2017 | Jeong | A41B 11/003 |
| 2018/0228247 | A1 * | 8/2018 | Muller | A43B 7/142 |
| 2018/0289099 | A1 * | 10/2018 | Bell | A43B 3/124 |
| 2018/0332920 | A1 * | 11/2018 | Burch | A43B 13/40 |
| 2019/0167462 | A1 * | 6/2019 | Shaffer | A61F 5/019 |
| 2020/0329782 | A1 * | 10/2020 | Kim | A41B 11/00 |

FOREIGN PATENT DOCUMENTS

| | | | |
|---|---|---|---|
| CN | 100566611 | C | 12/2009 |
| CN | 204120244 | U | 1/2015 |
| CN | 204306051 | U | 5/2015 |
| DE | 10341766 | A1 | 4/2004 |
| DE | 102008020993 | A1 | 10/2009 |
| DE | 202009010997 | U1 | 11/2009 |
| DE | 202011051102 | U1 | 10/2011 |
| EP | 0849998 | B1 | 8/1999 |
| EP | 1813159 | A1 | 8/2007 |
| EP | 1997394 | A1 | 12/2008 |
| JP | 52-040220 | | 3/1977 |
| JP | 63-040933 | | 3/1988 |
| JP | 02-003404 | | 1/1990 |
| JP | 2006-348399 | | 12/2006 |
| JP | 2010-189783 | A | 9/2010 |
| KR | 20-0352843 | Y1 | 6/2004 |
| WO | 2009/066281 | A2 | 5/2009 |

OTHER PUBLICATIONS

Office Action dated Jun. 28, 2019, in corresponding Chinese Application No. 201680061351.0; 8 pages.

Search Report dated Jun. 20, 2019, in corresponding Chinese Application No. 201680061351.0; 3 pages.

Chinese Office Action dated Apr. 24, 2020, in connection with corresponding CN Application No. 201680061351.0 (8 pgs., including machine-generated English translation).

Japanese Office Action dated Aug. 25, 2020, in connection with corresponding JP Application No. 2018-541509 (7 pp., including machine-generated English translation).

* cited by examiner

SOCK COMPRISING STIMULATION ELEMENTS

FIELD

The invention relates to the field of footwear, particularly to socks.

BACKGROUND

From EP 0 849 998 B1, there is known a sock with reinforced portions. The sock is reinforced, on the one hand, in the heel and toe region because, while the sock is being worn, these regions will stress particularly intensely by the frictional contact with the shoe and thus will become worn out quickly. In addition to the heel and toe region, also a so-called impact zone between the toe and heel regions should be reinforced. A teaching on the positioning of a corresponding reinforcement is not disclosed. It is mentioned, however, that said impact zone reinforcement is to be formed in the region of a foot impact area so that the sock is reinforced in the wear-prone regions. The gist of the idea of EP 0 849 998 B1 appears to reside in the reinforcing of the impact zones of a sock since, in use, these have to endure particularly heavy stress. Said document does not deal with non-impact zones.

A disadvantage of the above known sock consists in that, during walking, the reinforcements in the impact zones may happen to destabilize the foot. Reinforcements in the impact zones may also cause a "spongy" impact feeling. This may also occur in socks that are reinforced in the entire sole region. Further, it may happen that, due to the reinforcements in the impact zones, an otherwise well-fitting shoe will not offer enough space anymore when the user is wearing the sock.

SUMMARY

It is an object of the present invention to provide a sock that has improved wearing comfort and improved stability characteristics for the foot of the wearer. This object is achieved by the subject matter defined in claim 1. The dependent claims define advantageous embodiments of the invention.

The invention relates to a sock. The sock, as also illustrated in the Figures, can be of the widespread type which, in addition to a foot portion covering the wearer's foot, comprises an adjoining shaft portion covering a lower part of the leg. However, also other types of socks are comprised under the definition, e.g. so-called ankle socks that only cover the foot of the wearer and have no shaft portion, or also socks that particularly can have a very long shaft portion.

The sock according to the invention comprises a sole which comprises impact zones in the toe region, in the ball region and in the heel region. The term "sole" herein is to denote that part of the sock which, during wearing, covers the sole of the wearer's foot. The sole comprises an inner side which is facing toward the sole of the wearer's foot, and an outer side, arranged opposite to the inner side and facing away from the sole of the wearer's foot, which particularly can be visible from the outside.

The position and the shape of the impact zone is determined by the geometry of the human foot. The impact zones of the sole can at least substantially be regions which, when the sock is worn, cover impact regions of the sole of the foot. Impact regions of the sole of the foot herein can be those regions which typically are in contact with a plane surface when the respective foot is standing barefoot on the plane surface.

According to at least some embodiments, the impact zones of the sole of the sock will, when the sock is being worn by a person standing on a plane surface, get into contact with the plane surface.

According to the invention, the sole comprises a toe groove region located between the toe region and the ball region, and a metatarsal arch region located between the ball region and the heel region. The outer regions, by contrast, are designed without stimulation elements.

Said toe groove region and said metatarsal arch region are non-impact zones of the sole. Also the position and the form of the non-impact zones are determined by the geometry of the human foot. The non-impact zones of the sole can at least substantially be zones which, when the sock is being worn, cover non-impact regions of the sole of the foot. Herein, non-impact regions of the sole of the foot can be those regions which typically are spaced from a plane surface when the respective foot is standing barefoot on said plane surface.

According to at least some embodiments, the toe groove region, the metatarsal arch region and/or a still-to-be described triangle region are, when the sock is being worn by a person standing on a plane surface, spaced from said plane surface.

Since the toe groove region is located between the toe region and the ball region, its position while the sock is being worn will correspond to the position and the course of the deepened region (toe groove) between the tips of the toes which are normally in ground contact when the person is standing and the balls of the foot which likewise are in ground contact when the person is standing. In other words: In the state when the sock is being worn, the toe groove region of the sock is situate opposite to the region of the proximal interphalangeal joints (PIP) of the foot, i.e. the deepened portion, formed by these joints, between the proximal phalanges and the intermediate phalanges of the 2nd to 5th toes (digitus pedis II to V) and respectively between the proximal phalanx and the distal phalanx of the first toe (digitus pedis I).

The metatarsal arch region of the sole is located between the ball region and the heel region particularly in such a manner that, when the sock is being worn, it will cover the metatarsal arch, i.e. the concave indentation of the foot situated at the respective inner side of the foot between the ball and heel regions.

Thus, the stimulation elements are arranged in zones of the sole of the sock that cover non-impact regions of a sole of a foot. The impact regions of the sole in the toe region, in the ball region and in the heel region, however, are free of stimulation elements. The arrangement of the stimulation elements according to the present invention is thus the opposite to the arrangement of the reinforcement regions according to EP 0 849 998 B1 that shall be located exactly on the massively stressed impact zones so as to reinforce the same.

The stimulation elements of the present invention have the effect of mechanically stimulating the foot of a wearer and thus enhancing the blood circulation. Since, in consideration of the geometry of the human foot, the stimulation elements are provided only in zones of the sole which are of no or little relevance for the impacting of the foot, they will—in contrast to the reinforcement regions according to EP 0 849 998 B1—have no negative influence on the stability of the wearer's foot. Instead, by the stimulation elements, non-filled regions between a standing foot and a corresponding underlying ground surface are at least partially filled so that the foot will be stabilized.

Preferably, an impact zone free of stimulation elements is provided also in a web region laterally flanking the metatarsal cavity region and located between the ball region and the heel region. Particularly, this impact zone free of stimulation elements can connect the ball region and the heel region to each other.

To further increase the stimulation effect, the sole can comprise stimulation elements also in a substantially triangular triangle region. This triangle region can be a further non-impact zone. The triangle region can be arranged on the other side of the web region relative to the metatarsal arch region and adjoin the heel region. Thus, the web region which is free of stimulation elements separates the metatarsal arch region which comprises stimulation elements and the triangle region which likewise comprises stimulation elements.

The stimulation elements can be located on the outer side of the sole so that, when the sock is being worn, they are visible from the outside. Stimulation elements provided on the outer side of the sole are of particular advantage especially with respect to the stabilization properties. When the foot is impacting onto a plane underlying surface, they at least partially fill hollow spaces existing between said plane underlying surface and non-impact zones of the sole of the sock (particularly the toe groove region, the metatarsal arch region and/or the triangle region). Further, a foot that is clad with the sock is mechanically stimulated in the respective non-impact regions.

The stimulation elements can also be located on the inner side of the sole, i.e. within the interior of the sock, and thus not be visible when the sock is being worn. By stimulation elements arranged on the inner side of the sole, a particularly good stimulation effect can be obtained because, when the sock is being worn, the stimulation elements get into direct contact with the foot. Also the stimulation elements provided internally will contribute to stability because they fill a volume between the respective non-impact regions of the sole of the sock (particularly the toe groove region, the metatarsal arch region and/or the triangle region) and the wearers' foot.

It is also possible to provide stimulation elements both on the inner side and on the outer side of corresponding regions of the sole. By the direct contact of the inner stimulation elements with the sole of the wearer's foot, a very good stimulation effect can be reached. Since the sole of the sock comprises stimulation elements both toward the inside and toward the outside, an optimal adaptation to the shape of the wearer's foot and to the corresponding underlying surface, e.g. a shoe interior, can be safeguarded, thus lending optimum support to the foot.

Of course, it can also be envisioned that, in certain regions of the sole, the stimulation elements are provided on the inner side or on the inner and outer sides and, in other regions of the sole or in the rest of the regions of the sole comprising stimulation elements, the stimulation elements are provided on the outer side or both on the inner and outer sides.

In order to realize the stimulation effect and the support effect in a favorable manner, the stimulation elements can be raised above the impact zones of the sole. It can also be envisioned to form the stimulation elements with different heights in different regions.

The stimulation elements can be or comprise bristle-like elements, particularly bristle-like textile elements. The stimulation elements can be or comprise hair-like needles that can particularly impart a fur-like feeling. The stimulation elements can be formed as pin-like or thread-like animating elements or comprise pin-like or thread-like animating elements. To achieve good adaptability to a foot, the stimulation elements can be flexible, elastic and/or bendable, wherein, particularly, they can have a certain stiffness so as to fulfill the stimulation function well.

The stimulation elements can comprise plush. Particularly, in the toe groove region, in the metatarsal arch region and/or in the triangle region, the sole can comprise a plush surface on the inner side and/or on the outer side for forming the stimulation elements.

Since the distribution of the stimulation elements is adapted specially to the geometry of the human foot, a difference has to be made between a left-hand sock and a right-hand sock. Particularly, the stimulation elements can be arranged asymmetrically relative to an axis running centrally in the extension direction of the sole (from the heel region to the toe region). A wearer will notice immediately if he/she has mistakably put on the sock on the wrong foot because, in such a case, the distribution of the stimulation elements will not correspond to the geometry of the foot.

BRIEF DESCRIPTION OF THE DRAWINGS

The invention will be explained hereunder by way of exemplary embodiments with reference to the accompanying drawings. In the drawings, the following is shown.

DETAILED DESCRIPTION OF THE DRAWINGS

Figure 1:
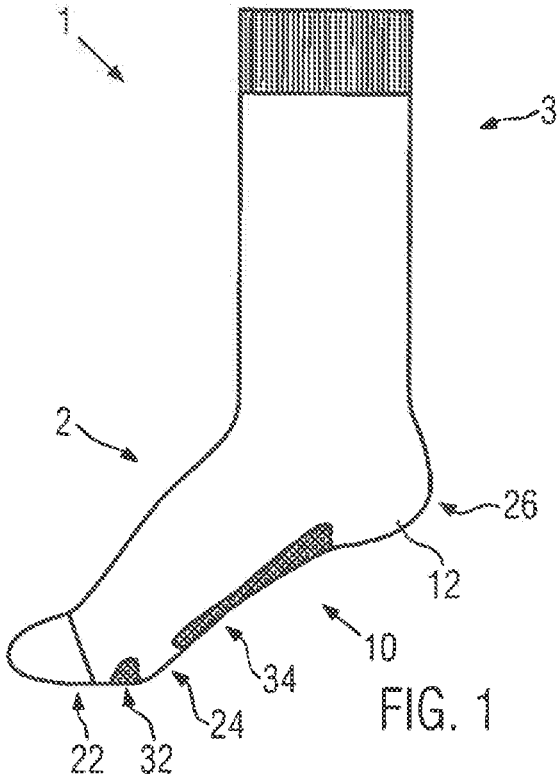
FIG. 1 is a schematic lateral view of a sock of the invention according to one embodiment, when folded into a flat configuration.

FIG. 1 shows, in schematic lateral view, a sock 1 of the invention according to one embodiment. The sock 1 comprises a foot portion 2 for covering a foot and a shaft portion 3 for covering a lower region of a wearer's leg.

Figure 2A:
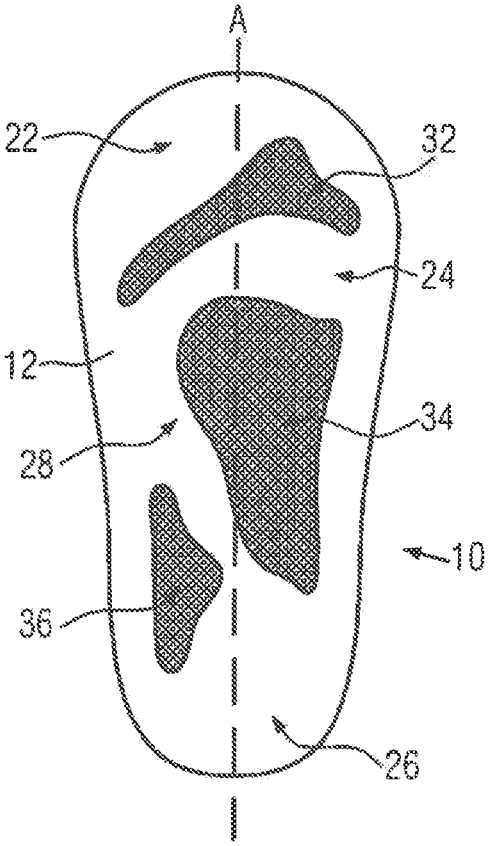
FIG. 2*a* is a schematic plan view onto an outer side of the sole of a right-hand sock according to one embodiment.

FIG. 2*a* shows a schematic plan view onto an outer side 12 of a sole 10 of the sock 1 of the invention. In the illustrated view, the sock 1 is the one on the right-hand side. Of course, however, both left-hand-side socks and right-hand-side socks 1 are comprised under the scope of the invention. A corresponding left-hand-side sock 1 could be designed particularly as a mirror image to the right-hand-side sock shown herein. In the toe region 22, in the ball region 24, in the heel region 26 and in a web region 28 connecting the ball region 24 and the heel region 26, the sole 10 comprises impact zones. When the sock 1 is being worn, these impact zones will cover impact regions of a sole F of a foot that, due to the geometry of the foot, will get into contact with a plane underlying ground.

The sole 10 further comprises non-impact zones which, when the sock 1 is being worn, will cover regions of the sole F of the foot which, when the wearer is standing, are—due to the geometry of the foot—spaced from the plane underlying ground. One such non-impact zone is the toe groove region 32 situated between the toe region 22 and the ball region 24. A further non-impact zone is the metatarsal arch region 34 situated between the ball region 24 and the heel region 26. On the left-hand side in FIG. 2, the metatarsal arch region 34 is flanked by the web region 28. By the heel region 26 and the web region 28, a further non-impact zone, the triangle region 36, is delimited on the side of the web region 28 opposite to the metatarsal arch region 34. The triangle region has a substantially triangular shape.

Figure 2B:
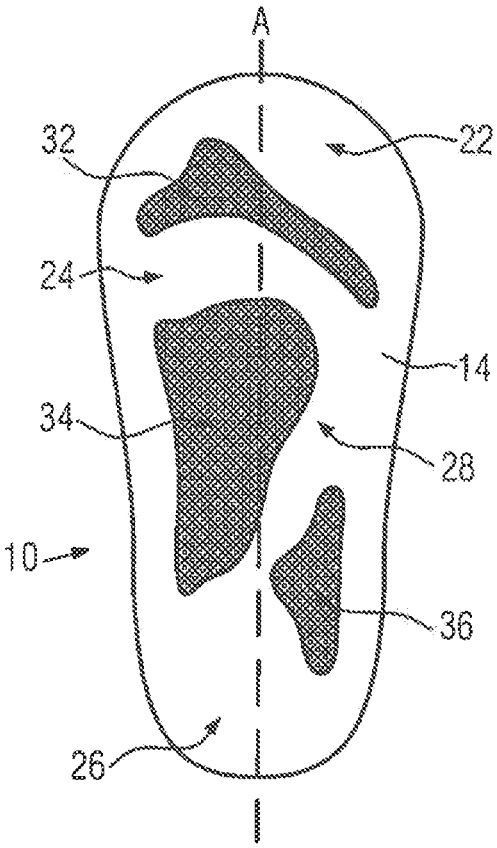
FIG. 2*b* is a schematic plan view onto an inner side of the sole of a right-hand sock according to one embodiment.

FIG. 2*b* shows the position of the various impact zones and non-impact zones of the right-hand sock 1 in plan view onto the inner side 14 of the sole 10 of sock 1. As evident, the distribution of the impact zones and non-impact zones as seen in plan view onto the inner side 14 of the sole 10 is the mirror image of the distribution of the impact zones and non-impact zones as seen in plan view onto the outer side 12 of the sole 10.

According to the invention, at least the toe groove region 32 and the metatarsal arch region 34 comprise stimulation elements 40. Also the triangle region 36 can comprise stimulation elements 40. The toe groove region 32, the metatarsal cavity region 34 and/or the triangle region 36 can comprise stimulation elements 40 distributed over their entire surface. It can also be envisioned that only partial regions of the toe groove region 32, the metatarsal arch region 34 and/or the triangle region 36 comprise stimulation elements 40.

The stimulation elements 40 can be or comprise bristle-like elements, particularly bristle-like textile elements. The stimulation elements 40 can be or comprise hair-like needles that can particularly impart a fur-like feeling. The stimulation elements 40 can be formed as pin-like or thread-like animating elements or comprise pin-like or thread-like animating elements. To achieve good adaptability to a foot, the stimulation elements can be flexible, elastic and/or bendable, wherein, particularly, they can have a certain stiffness so as to fulfill the stimulation function well. Preferably, the stimulation elements 40 comprise plush. For forming the stimulation elements 40, the toe groove region 32 and the metatarsal arch region 34 can be provided with a plush surface across the entirety of the outer side 12 and/or the inner side 14. The stimulation elements 40, particularly the plush, are raised relative to the impact zones of the sole 10.

Figure 3:
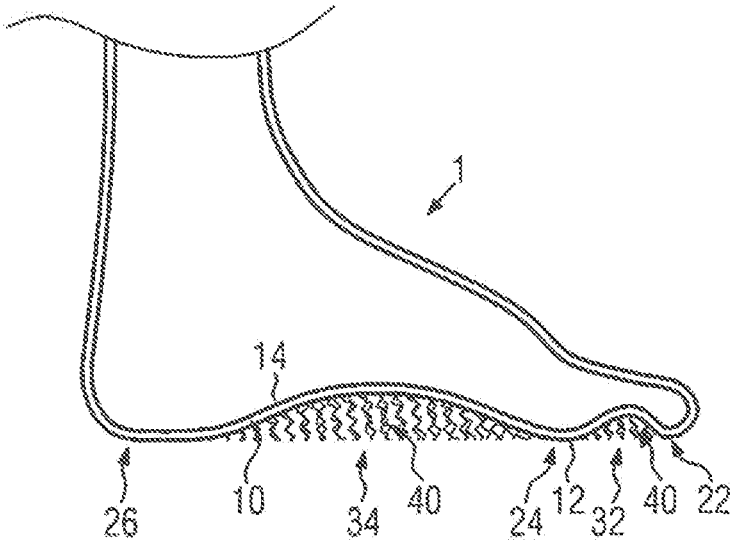
FIG. 3 is a schematic sectional view of a sock of the invention according to one embodiment.

FIG. 3 shows a schematic sectional view of a sock 1 of the invention as seen along an axis A running centrally in the extension direction of the sole 10 from the heel region 26 to the toe region 22 (see FIGS. 2*a* and 2*b*). In FIG. 3, the sock 1 is shown in the state of being worn, so that the sock adheres to the wearer's foot and takes a shape corresponding to the foot, wherein, for the sake of better survey, the foot is not illustrated. From FIG. 3, it is clearly evident that, dictated by the geometry of the foot, the sole 10 comprises impact regions (toe region 22, ball region 24 and heel region 26) and non-impact regions (toe groove region 32 and metatarsal arch region 34).

In the embodiment shown in FIG. 3, the stimulation elements 40 in the toe groove region 32 and in the metatarsal arch region 34 are provided on the outer side 12 of the sole 10. The stimulation elements 40 are illustrated as bristle-shaped textile elements and can e.g. comprise plush. In the Figures, the bristle-shaped textile elements are depicted with a relatively large length for easier illustration. In practice, of course, the length of the stimulation elements 40 can be adapted in a flexible manner. Particularly, relative to the impact zones of the sole 10, the stimulation elements 40 can be raised by less than 3 mm, less than 5 mm, less than 1 cm or more than 3 mm, more than 5 mm or more than 1 cm.

As can be seen in FIGS. 3, when treading onto a plane surface B (see FIG. 4*a*), the stimulation elements 40 will at least partially fill the intermediate space—occurring in the region of the non-impact surfaces, particularly in the toe groove region 32 and in the metatarsal arch region 34—between the sole 10 of the sock 1 and respectively of the wearer's foot and the plane surface B. Thereby, when the wearer is standing, pressure is exerted, via the stimulation elements 40, also onto the non-impact regions of the foot so that the feet will be stimulated, which e.g. can enhance the blood circulation.

Figure 4A:
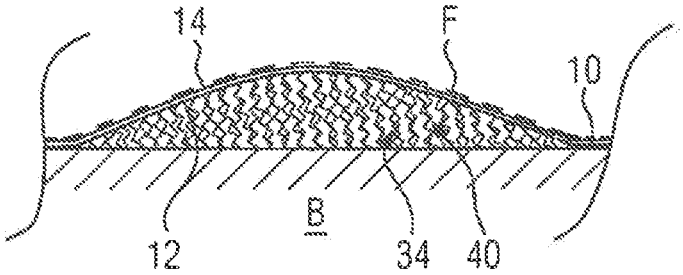
FIG. 4*a* is a partial view, in the form of schematic longitudinal sectional views, of a sock of the invention according to different embodiments, wherein the metatarsal arch region is shown.

FIG. 4*a* shows a portion of the view of FIG. 3 including the metatarsal arch region 34, while also schematically showing the sole F of the foot of a wearer of the sock 1 and the plane surface B on which the foot is standing.

Figure 4B:
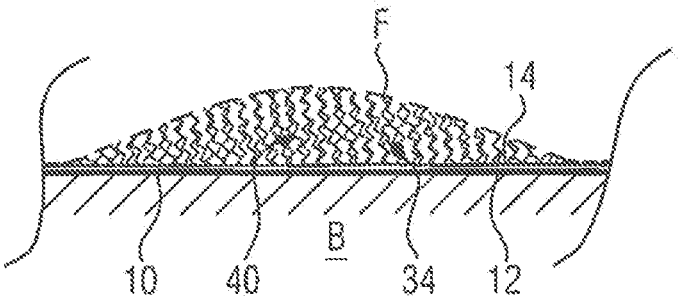
FIG. 4*b* is a partial view, in the form of schematic longitudinal sectional views, of a sock of the invention according to different embodiments, wherein the metatarsal arch region is shown.

FIG. 4*b* shows a corresponding view of the sock according to an alternative embodiment. According to FIG. 4*b*, in difference to the embodiment shown in FIGS. 3 and 4*a*, the stimulation elements 40 in the metatarsal arch region 34 are provided not on the outer side 12 of the sole 10 but on the inner side 14 of the latter. Thus, the stimulation elements 40 are arranged between the sole F of the foot of a wearer the sock 1 and the inner side 14 of the sole 10 of the sock 1. The stimulation elements 40 will thereby get into direct contact with the sole F of the foot so that the sole can be stimulated in a particularly good manner. The support function effected by said filling of the intermediate space—resulting from the foot geometry—between the plane surface B and the sole F of the foot of the wearer is existent also here. Of course, the stimulation elements 40 can be provided on the inner side 14 of the sole 10 also in the toe arch groove 32 and in the triangle region 36.

Figure 4C:
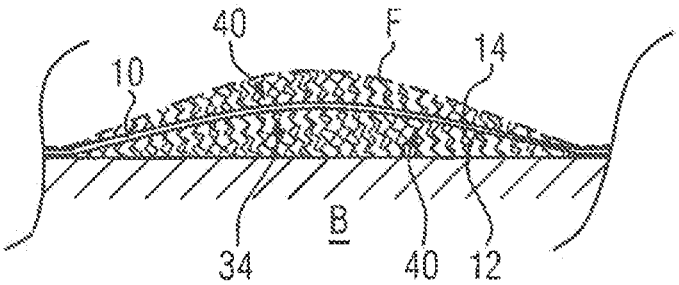
FIG. 4*c* is a partial view, in the form of schematic longitudinal sectional views, of a sock of the invention according to different embodiments, wherein the metatarsal arch region is shown.

FIG. 4*c* shows the metatarsal arch region 34 of a further alternative embodiment. Here, stimulation elements 40 are applied both on the inner side 14 and on the outer side 12 of the sole 10. Also this design can be easily transferred to the toe groove region 32 and/or the triangle region 36. Due to the stimulation elements 40 provided on the inner side 14, this embodiment according to FIG. 4*c* allows for a direct contact between the sole F of the foot and the stimulation elements 40 so that the sole F of the foot can be stimulated in a particularly effective manner. Since stimulation elements 40 are provided on both sides of the sole 10, it is rendered possible in a simple manner to achieve a large overall thickness in the corresponding non-impact zone so that the foot can be given a particularly good stabilization.

As shown in FIGS. 4*a* to 4*c*, the distance between the plane surface B and the sole F of the foot of the wearer of the sock is not constant across the metatarsal arch region 34. For this reason, it could be conceived to adapt the height of the stimulation elements 40 correspondingly and to vary it across the metatarsal arch region 34. Particularly in case of relatively low stimulation elements 40, however, it can also be advisable to keep the height of the stimulation elements 40 at a constant level. Further, it can be advantageous if the stimulation elements 40 are flexible to the effect that they will adapt to the contour of the foot in a suitable manner.

The invention claimed is:

1. A sock having a sole, comprising:

impact zones in the toe region, the ball region, the lateral arch region, and the heel region, a non-impact zone in a toe groove region situated between the toe region and the ball region;

wherein the toe region encompasses a semicircular region abutting and including a front edge of the sole, the heel region encompasses a semicircular region abutting and including a rear edge of the sole, and the lateral arch region encompasses an elongated region abutting and including an outer lateral edge of the sole with respect to a longitudinal axis A of the sole;

wherein the sole comprises stimulation elements distributed over an entire surface of the toe groove region, and distributed over an entire surface of a non-impact metatarsal arch region that is situated between the ball region and the heel region, the metatarsal arch region encompassing an elongated region abutting an inner lateral edge of the sole with respect to the longitudinal axis A, wherein the sock does not comprise stimulation elements in any part of the impact zones, and wherein, when the sock is being worn by a person standing on a plane surface, the non-impact zone is spaced from the plane surface and the impact zones contact the plane surface, and wherein the stimulation elements at least partially fill an intermediate space between a sole of the person's foot and the plane surface.

2. The sock according to claim 1, wherein the sole further comprises an impact zone in a web region situated between the ball region and the heel region in a longitudinal direction and flanking the metatarsal arch region in a lateral direction, said web region impact zone connecting the ball region and the heel region to each other.

3. The sock according to claim 2, wherein the sole further comprises stimulation elements distributed over an entire surface of a non-impact triangle region which is situated on an opposite side of the web region relative to the metatarsal arch region and is adjoining the heel region, and is situated entirely on an outer lateral side of the longitudinal axis A.

4. The sock according to claim 1, wherein, when the sock is being worn by a person standing on a plane surface, the impact zones get into contact with the plane surface.

5. The sock according to claim 1, wherein, when the sock is being worn by a person standing on a plane surface, the toe groove region, the metatarsal arch region and/or the triangle region are spaced from the plane surface.

6. The sock according to claim 1, wherein the impact zones of the sole are designed in such a manner that, when the sock is being worn, the impact zones of the sole of the sock are configured to cover regions of the sole of the foot which, when a foot is standing barefoot on a plane surface, get into contact with said plane surface.

7. The sock according to claim 1, wherein the stimulation elements are arranged on an inner side and/or on an outer side of the sole.

8. The sock according to claim 3, wherein at least partial regions of the toe groove region, the metatarsal arch region and/or the triangle region include stimulation elements on an inner side and on an outer side.

9. The sock according to claim 1, wherein the stimulation elements include plush.

10. The sock according to claim 3, wherein in the toe groove region, in the metatarsal arch region and/or in the triangle region, the sole includes a plush surface on the inner side or the outer side for forming the stimulation elements.

11. The sock according to claim 1, wherein the stimulation elements include bristle-like textile elements.

12. The sock according to claim 1, wherein the stimulation elements are arranged asymmetrically relative to an axis running particularly centrally in the extension direction of the sole from the heel region to the toe region.

* * * * *